US007513078B2

(12) United States Patent
Ho

(10) Patent No.: US 7,513,078 B2
(45) Date of Patent: Apr. 7, 2009

(54) ELECTRICAL FLOOR-HINGE DEVICE

(75) Inventor: Shun-Cheng Ho, Taipei (TW)

(73) Assignee: Grand Finale International Corp., Taipei (TW)

( * ) Notice: Subject to any disclaimer, the term of this patent is extended or adjusted under 35 U.S.C. 154(b) by 456 days.

(21) Appl. No.: 11/350,778

(22) Filed: Feb. 10, 2006

(65) Prior Publication Data

US 2007/0186479 A1 Aug. 16, 2007

(51) Int. Cl.
*E05F 15/02* (2006.01)

(52) U.S. Cl. ..... 49/334; 49/337; 49/335; 49/139; 49/140

(58) Field of Classification Search ..... 49/333, 49/334, 335, 337, 139, 140
See application file for complete search history.

(56) References Cited

U.S. PATENT DOCUMENTS

| | | | | | |
|---|---|---|---|---|---|
| 2,094,226 | A * | 9/1937 | Wagner | 49/333 |
| 4,599,824 | A * | 7/1986 | Mitsuhashi et al. | 49/141 |
| 5,417,011 | A * | 5/1995 | Keszthelyi | 49/334 |
| 5,791,204 | A * | 8/1998 | Torii et al. | 74/606 R |
| 6,108,975 | A * | 8/2000 | Bailey | 49/334 |
| 6,176,044 | B1 * | 1/2001 | Nixon et al. | 49/506 |
| 6,530,178 | B1 * | 3/2003 | Kowalczyk et al. | 49/334 |
| 6,588,153 | B1 * | 7/2003 | Kowalczyk | 49/380 |
| 6,651,386 | B2 * | 11/2003 | Long | 49/141 |
| 6,786,006 | B2 * | 9/2004 | Kowalczyk et al. | 49/334 |
| 2004/0057243 | A1 * | 3/2004 | Takii et al. | 362/512 |
| 2004/0244293 | A1 * | 12/2004 | Eckel et al. | 49/334 |
| 2006/0056921 | A1 * | 3/2006 | Simmons | 405/203 |

* cited by examiner

*Primary Examiner*—Jerry Redman
*Assistant Examiner*—Jeff Tang
(74) *Attorney, Agent, or Firm*—Leong C. Lei

(57) ABSTRACT

A novel electrical floor-hinge device is provided, which contains an electrical motor and a speed reducing element configured on top of a platform element at a side on top of a body member. A vertical input shaft connected to the speed reducing element is joined to a lateral involute shaft via bevel gears. The involute shaft in turn engages a driven gear on a vertical output shaft. The top end of the output shaft is attached to a seat element whose top surface is fixedly joined to a lower inner corner of a door. By the electrical motor's driving the seat element into clockwise or counterclockwise swing, the door is closed or opened automatically. The speed reducing element can be easily replaced to fit doors of different weight.

3 Claims, 9 Drawing Sheets

ELECTRICAL FLOOR-HINGE DEVICE

BACKGROUND OF THE INVENTION (a) Technical Field of the Invention

The present invention generally relates to floor hinges, and more particularly to an electrical floor-hinge device whose motor is arranged above the ground for easy maintenance.

(b) Description of the Prior Art

A conventional electrical floor hinge usually has its motor and transmission mechanism buried underground by the doorpost. When the electrical floor hinge fails, usually the door cannot be switched to manual operation, and the entire electrical floor hinge has to be dug out from the ground for repair, which is rather inconvenient in addition to the damage to the floor. In addition, a conventional electrical floor hinge is usually equipped with a transmission mechanism specifically for doors within a certain range of weight. If the door is replaced with one of different weight after the electrical floor hinge is installed, again, the entire electrical floor hinge has to be dug out and replaced.

SUMMARY OF THE INVENTION

The primary purpose of the present invention is to provides a novel electrical floor-hinge device to obviate the foregoing shortcomings of prior approaches. The electrical floor-hinge device mainly contains a body member having an electrical motor and a speed reducing element configured at a side. A vertical input shaft connected to the speed reducing element is joined to a lateral involute shaft via bevel gears. The involute shaft in turn engages a driven gear on a vertical output shaft. The top end of the output shaft is configured with a seat element fixedly attaching to a lower inner corner of a door. By the electrical motor's driving the seat element into clockwise or counterclockwise swing, the door is closed or opened automatically.

An elongated rod has its two ends joining to a deflecting bar extended from a ling on the top end of the output shaft, and a block extended from the bottom of the seat element, respectively. When the electrical floor-hinge device fails, the door can be manually opened or closed after releasing the elongated rod from either the deflecting bar or the block of the seat element.

The body member is assembled by embedding a cover element into the top opening of a basin element. As such, when building the basin element under the ground and by filling the cement up to the height of the basin element, the cement wouldn't cover the interface between the cover element and the basin element. Additionally, around the top opening of the basin element, an encircling groove is provided for the installation of a washer for superior waterproofing.

The electrical motor and the speed reducing element are configured on a platform element which is provided at an end on top of the cover element. The electrical motor and the speed reducing element are then enclosed by the platform element and a casing element. A number of grooves are provided along the lateral sides of the platform element for the installation of washers, which provides superior waterproofing.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
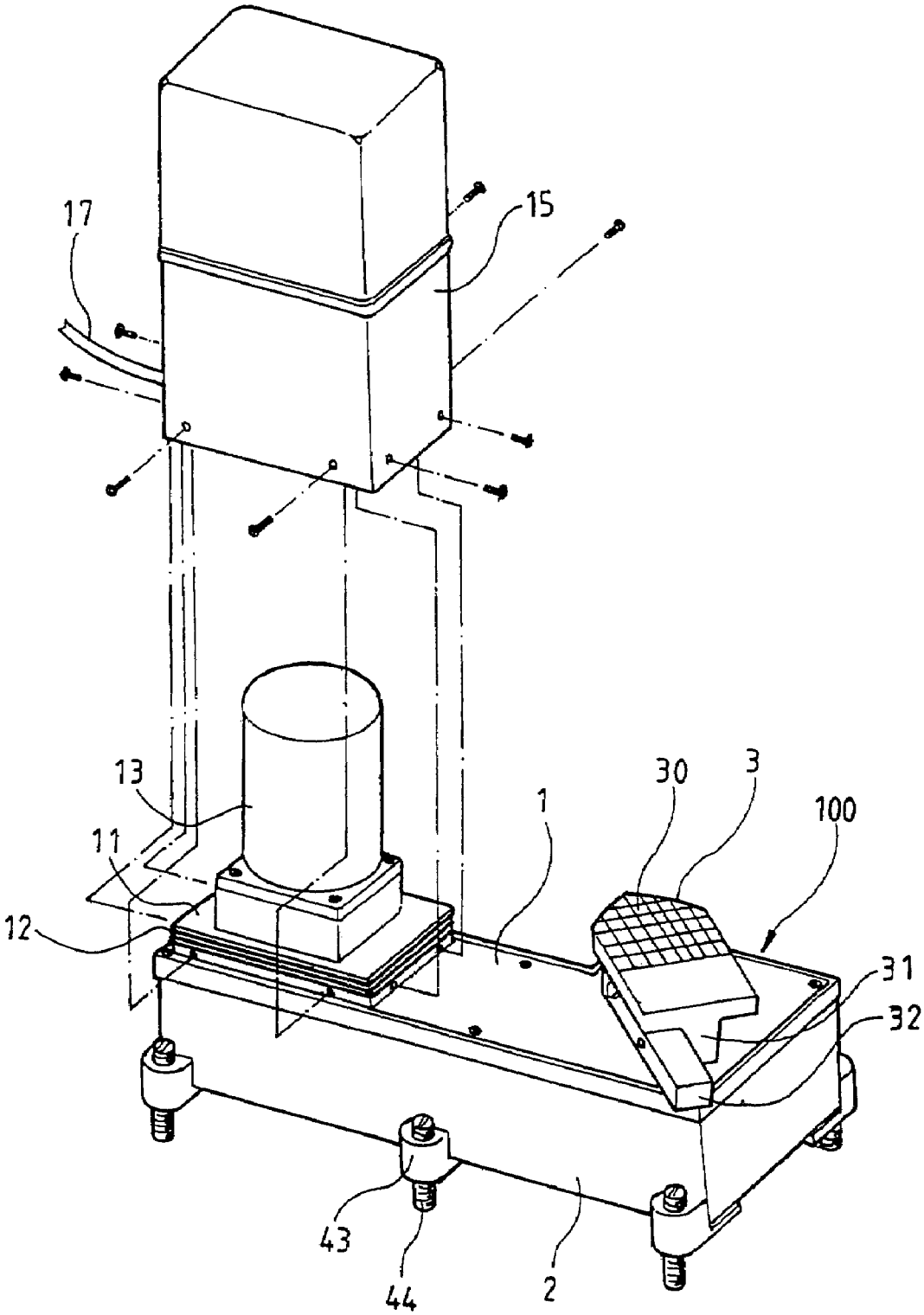
FIG. 1 is a perspective view showing the electrical floor-hinge device according to the present invention.
Figure 2:
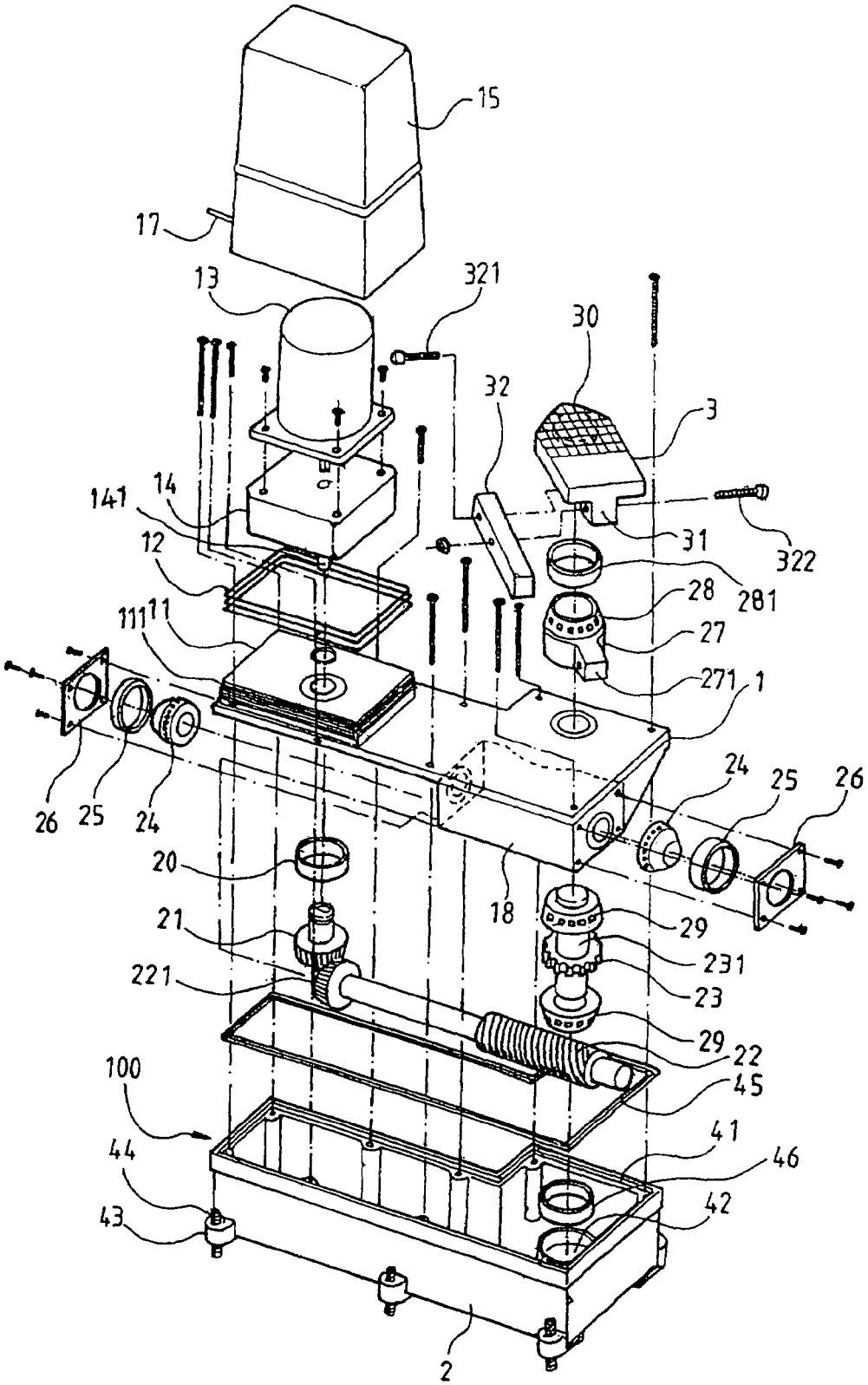
FIG. 2 is a perspective exploded view showing the various components of the electrical floor-hinge device of FIG. 1.
Figure 3:
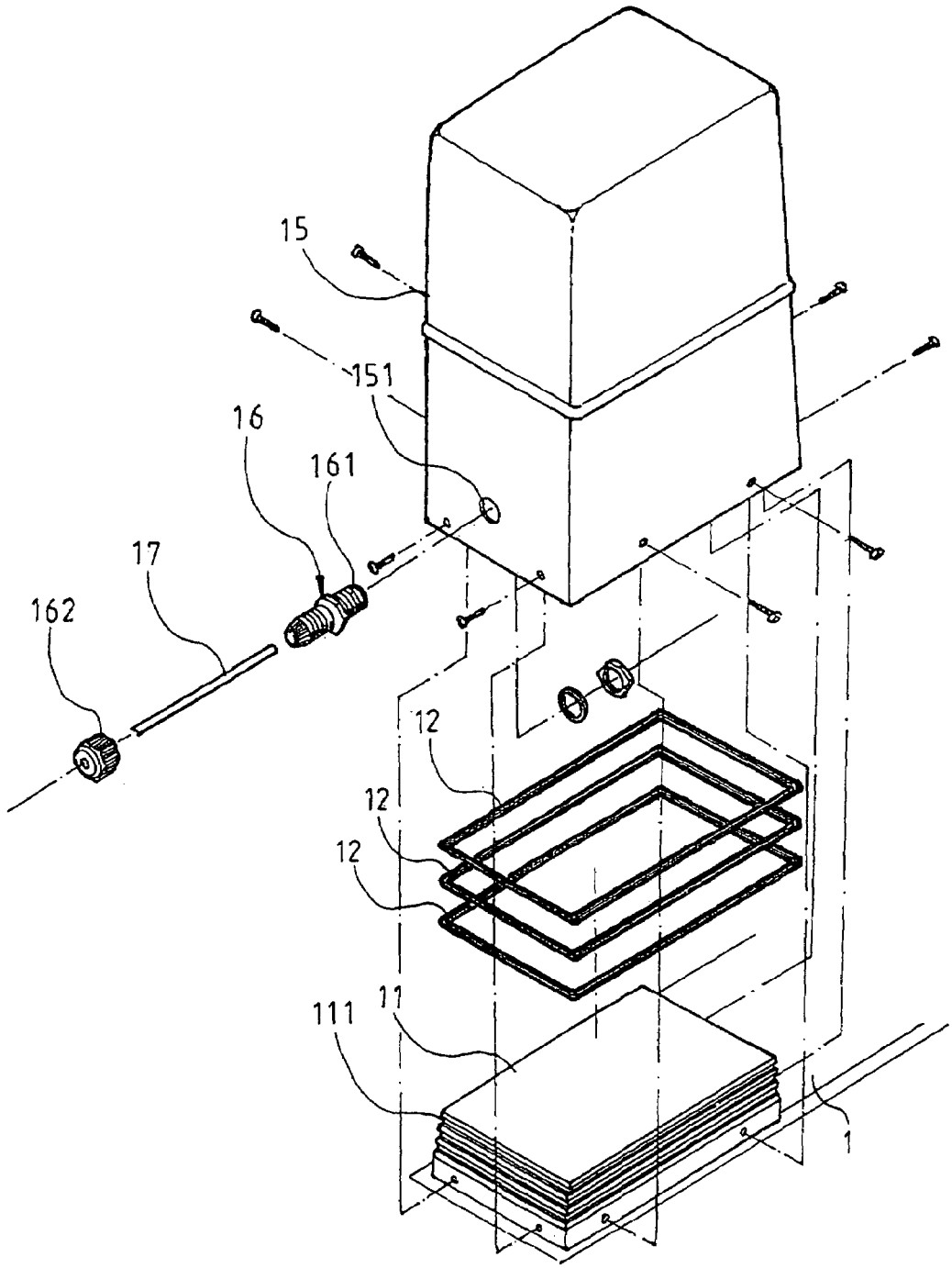
FIG. 3 is a perspective view showing the joining of the casing element to the platform element of FIG. 1

As shown in FIGS. 1 to 3, the electrical floor-hinge device according to an embodiment of the present invention contains a hollow body member 100 formed by a cover element 1 and a basin element 2. At an end of the body member 100, a platform element 11 is provided on top of the cover element 1, upon which a speed reducing element 14 and an electrical motor 13 are configured in this order from bottom to top. The speed reducing element 14 delivers an appropriate torque generated from the electrical motor 13 to an input shaft 141 connected to the speed reducing element 14. The speed reducing element 14 and the electrical motor 13 are sealed in a closed space formed by placing a casing element 15 over the platform element 11. Around the lateral sides of the platform element 11, a number of grooves 111 are provided for the installation of a same number of washers 12 to achieve superior waterproofing to the closed space. At an appropriate location on a lateral side of the casing element 15, a through hole 151 is provided. A power cable 17 connected to the electrical motor 13 is threaded through the through hole 151 via a plugging element 16 which contains a tubular collar 161 and a fastening ring 162.

The input shaft 141 connected to the speed reducing element 14 penetrates vertically through the cover element 1 into the basin element 2. Inside the basin element 2, the input shaft 141 has a bevel gear 21 at its end, which is joined to another bevel gear 221 at an end of an involute shaft 22. The other end of the involute shaft 22 penetrates through a chamber 18 beneath the cover element 1 via two cone bearings 24 at the entrance and the exit to the chamber 18 respectively so that the involute shaft 22 is held laterally beneath the cover element 1 and a threaded segment of the involute shaft 22 is housed inside the chamber 18. Each of the two cone bearings 24 is fixedly attached to the chamber 18 by a ling element 25 and a stopping plate 26. The threaded segment of the involute shaft 22 is joined to a driven gear 23 at the middle section of a vertical output shaft 231. A top end of the output shaft 231 penetrates upward through the cover element 1 and is configured with a ring 27 having an extended deflecting bar 271. a cone bearing 28, and a ring element 281. The bottom end of the output shaft 231 is configured with a cone bearing 29. Along the output shaft 231 and between the driven gear 23 and the ring 27, another cone bearing 29 is provided.

A seat element 3 is fitted on the cone bearing 28 at the top end of the output shaft 231. The seat element 3 has a scale 30 engraved on its top surface and a block 31 extended from the bottom. An elongated rod 32 has its two ends fixedly locked to the deflecting bar 271 with a screw 321 and to the block 31 with another screw 322 respectively.

The basin element 2 has a plurality of leveling elements 43 provided along the bottom edges outside the basin element 2. A number of screws 44 through the leveling element 43 are used to adjust the level of the body member 100. A groove 41 is provided around the top opening of the basin element 2 so that, after the cover element 1 is placed inside the top opening of the basin element 2, a washer 45 is embedded into the groove 41 for superior waterproofing to the body member 100. Inside the basin element 2, a cylindrical seat 42 is provided on the bottom floor for supporting and accommodating the cone bearing 29 at the bottom end of output shaft 231 after it is surrounded by a ring element 46.

To use the electrical floor-hinge device, the body member 100 is buried underground by a door post with the top opening of the basin element 2 roughly flush against the ground. An inner (i.e., adjacent to the doorpost) corner of the door is fixedly attached to the top surface of the seat element 3 and, by the torque delivered from the electrical motor 13 to the seat element 3, the door is turned open or close automatically.

Figure 4:
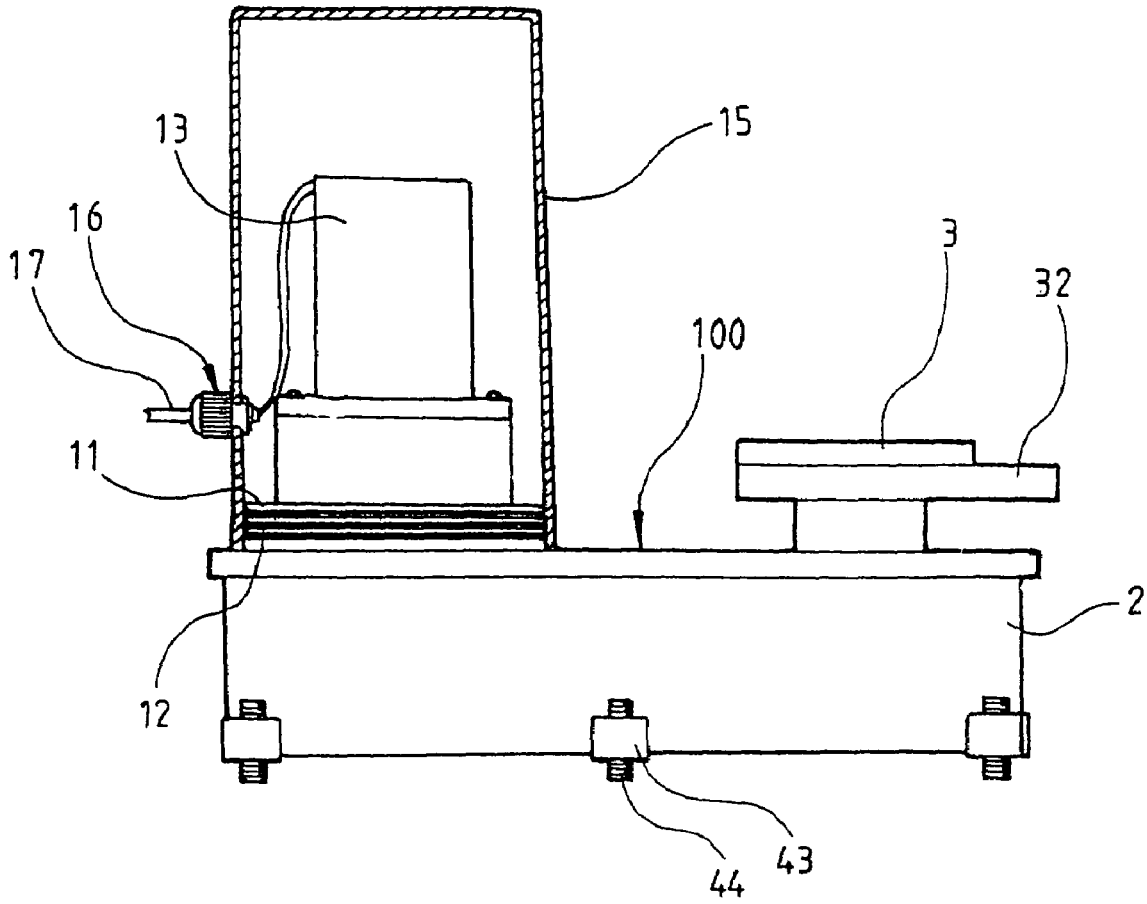
FIG. 4 is a sectional view showing the electrical floor-hinge device of FIG. 1
Figure 5:
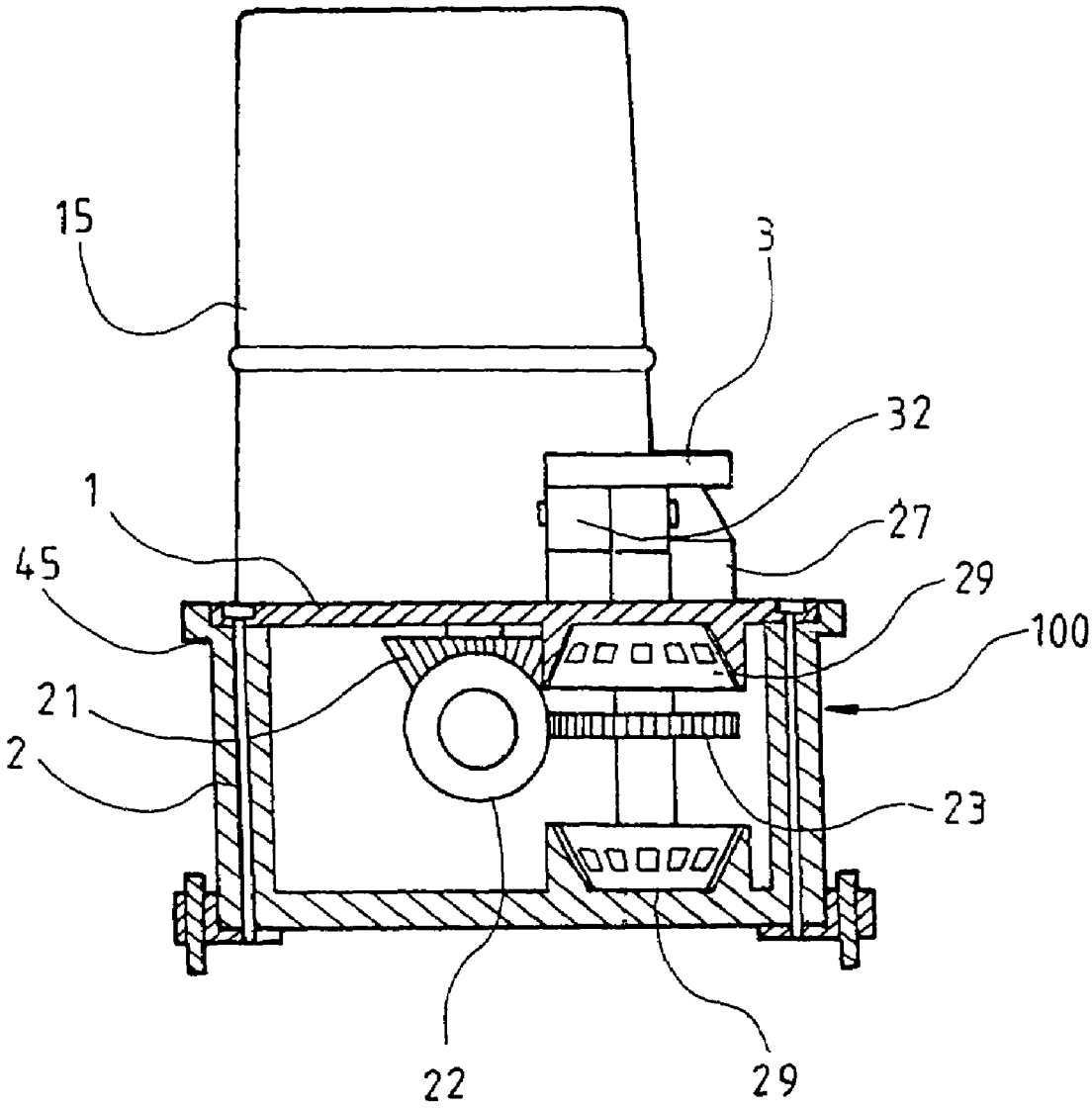
FIG. 5 is a cross-sectional view showing the electrical floor-hinge device of FIG. 1

Please refer to FIGS. 4 and 5. The cover element 1 and the basin element 2 can be easily joined together and separated apart with washer 45 along their interface for waterproofing. Similarly, the interface between the platform element 11 and the casing element 15 is also protected by a number of washers 12 for superior waterproofing.

Figure 6:
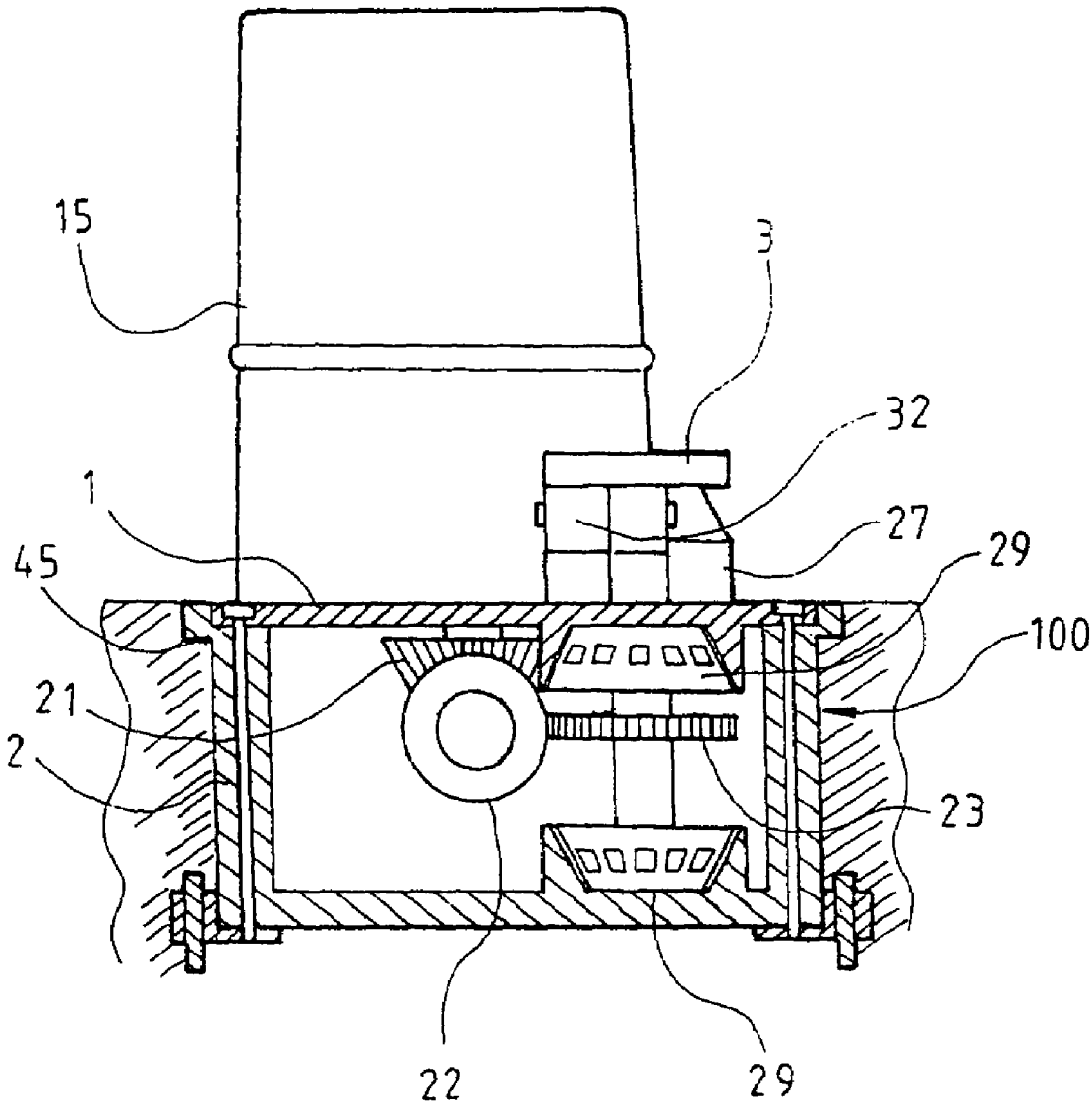
FIG. 6 is a cross-sectional view showing the installation of the electrical floor-hinge device of FIG. 1 after the body member is buried underground.
Figure 7:
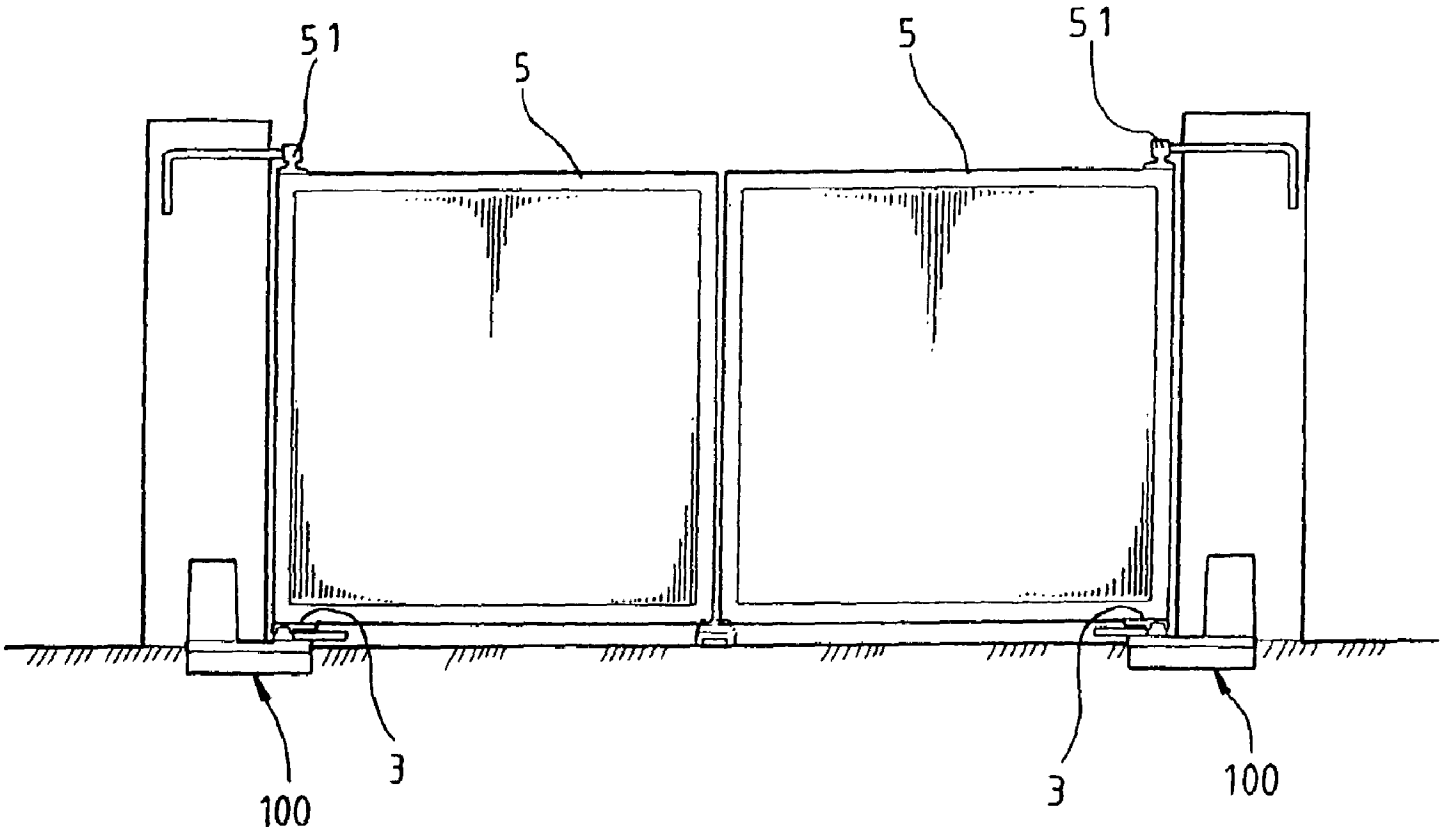
FIG. 7 is a schematic view showing the application of the electrical floor-hinge device of FIG. 1 to a pair of doors.

As shown in FIGS. 6 and 7, when the body member 100 is buried underground by the doorpost, the screws 44 threading through the leveling elements 43 are used to adjust the level of the body member 100. Then cement is filled until it flushes against the top of the basin element 2. As the cover element 1 is embedded inside the basin element 2, the cement wouldn't cover the interface between the cover element 1 and the basin element 2.

After the body member 100 is installed, a lower inner corner of a door 5 is fixedly attached to the top surface of the seat element 3 by, for example, welding. The scale 30 on the top surface of the seat element 3 helps to properly align the door 5 against the seat element 3. The door 5 has its upper inner corner joined to a rotating mechanism 51 extended from the doorpost. When the electrical motor 13 engages, the seat element 3 is turned either counterclockwise or clockwise and the door 5 is in turn opened or closed. If the electrical floor-hinge device fails, the cover element 1 can be removed from the body member 100 to expose the inside of the boded member 100 for repair.

Figure 8:
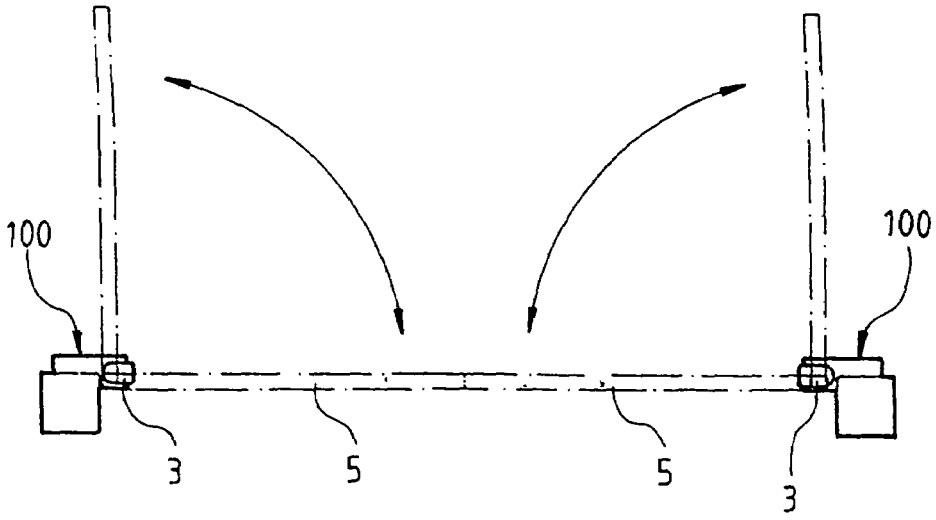
FIGS. 8 and 9 are top views showing the operation of the electrical floor-hinge device of FIG. 1 to doors of different size and weight.
Figure 9:
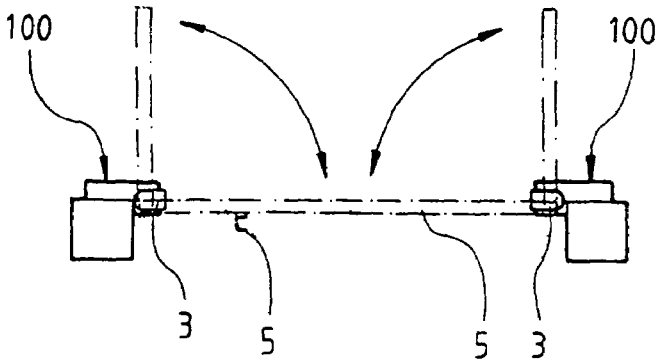

As shown in FIGS. 8 and 9, the electrical floor-hinge device can be applied to doors of different size and weight. If the door 5 is replaced by one with different weight, a user can easily open the casino element 15 and replace the speed reducing element 14 with one appropriate to the new door's weight, instead of replacing the entire electrical floor-hinge device.

Figure 10:
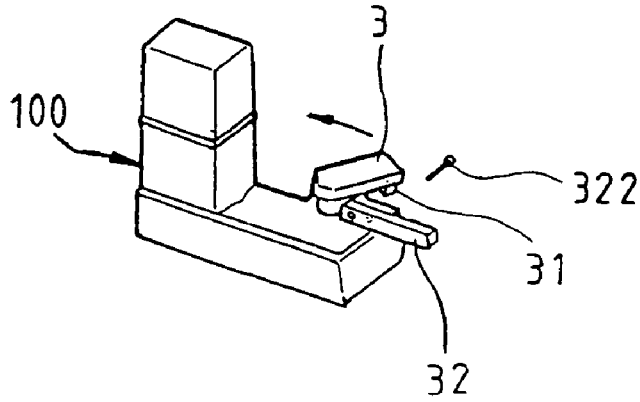
FIGS. 10, 11, and 12 are perspective views showing how the elongated rod of FIG. 1 is released for manual operation of the door.
Figure 11:
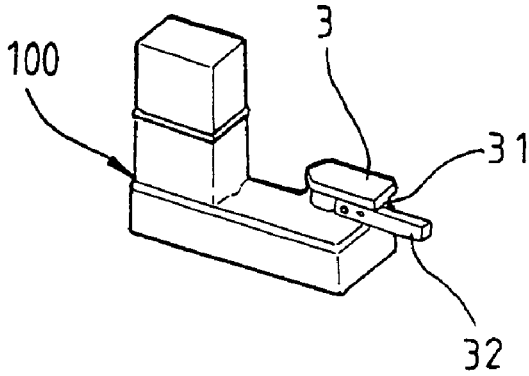
Figure 12:
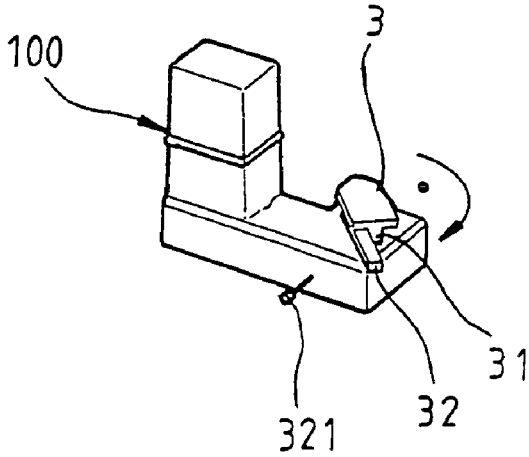

As shown in FIG. 10, if there is a malfunction and the electrical floor-hinge device fails to open a closed door, the screw 322 can be removed so that the seat element 3 is not locked to the elongated rod 32. The door then can be opened manually. On the other hand, if the electrical floor-hinge device fails when the door is open as shown in FIG. 12, the screw 321 can be removed so that the seat element 3 and the elongated rod 32 is detached from the deflecting bar 271, the door then can be manually closed as shoves in FIG. 11. Therefore, no matter what the status of the door is when the electrical floor-hinge device fails, the door can always be opened or closed manually and easily.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electrical floor-hinge device for automatically swinging a door open and close, comprising:

a hollow body member formed by a cover element and a basin element, said cover element having a top;

a platform element arranged at an end of said top of said cover element, said platform element having lateral sides provided with a plurality of grooves;

a plurality of washers engaged with said grooves;

an electrical motor;

a speed reducing element having an input shaft for delivering torque generated from said electrical motor, said input shaft being connected to said speed reducing element and penetrating vertically through said cover element into said basin element, said input shaft having a first bevel gear which is engaged with a second bevel gear mounted at a first end of said involute shaft, a second end of said involute shaft penetrating through a chamber beneath said cover element via two cone bearings at an entrance and an exit to said chamber thereby holding said involute shaft laterally beneath said cover element, a threaded segment of said involute shaft being housed inside said chamber, each of said cone bearings being fixedly attached to said chamber by a ring element and a stopping plate, said threaded segment of said involute shaft being joined to a driven gear at a middle section of a vertical output shaft, a top end of said output shaft penetrating upward through said cover element and configured with a ring having an extended deflecting bar, a cone bearing and a ring element, a bottom end of said output shaft being configured with a cone bearing, a cone bearing being provided along said output shaft between said driven gear and said ring;

said basin element having a cylindrical seat for supporting and accommodating said cone bearing at said bottom end of said output shaft;

a seat element fitted on a cone bearing at a top end of said output shaft; and an elongated rod having two ends fixedly locked to said deflecting bar with a first screw and to said block with a second screw.

2. The electrical floor-hinge device as claimed in claim 1, wherein said seat element has a top provided with a scale and a bottom provided with a block.

3. The electrical floor-hinge device as claimed in claim 1, wherein a plurality of screws are threaded through a plurality of leveling elements configured around a bottom edge of said basin element for adjusting level of said body member.

* * * * *